United States Patent [19]

Chin

[11] Patent Number: 4,988,432

[45] Date of Patent: Jan. 29, 1991

[54] REDUCING $NO_x$ EMISSIONS WITH ANTIMONY ADDITIVE

[75] Inventor: Arthur A. Chin, Cherry Hill, N.J.

[73] Assignee: Mobil Oil Corporation, Fairfax, Va.

[21] Appl. No.: 458,052

[22] Filed: Dec. 28, 1989

[51] Int. Cl.[5] ..... C10G 11/18

[52] U.S. Cl. ..... 208/121; 208/113; 208/149; 423/239; 502/42

[58] Field of Search ..... 208/113, 149, 52 CT, 208/121; 423/235, 239; 502/41, 42

[56] References Cited

U.S. PATENT DOCUMENTS

| | | | |
|---|---|---|---|
| 3,545,917 | 12/1970 | Stephens | 423/239 |
| 4,060,589 | 11/1977 | Hass et al. | 423/239 |
| 4,124,536 | 11/1978 | Itoh et al. | 502/245 |
| 4,235,704 | 11/1980 | Luckenbach | 208/113 |
| 4,434,147 | 2/1984 | Dimpfl et al. | 208/254 R |
| 4,521,389 | 6/1985 | Blanton, Jr. et al. | 208/120 |
| 4,778,665 | 10/1988 | Krishnamurthy | 208/120 |
| 4,784,752 | 11/1988 | Ramamoorthy et al. | 208/52 CT |
| 4,789,531 | 12/1988 | Eichlotz et al. | 423/239 |
| 4,847,054 | 7/1989 | Weisweiler | 502/41 |
| 4,847,058 | 7/1989 | Odenbrand et al. | 423/239 |
| 4,855,116 | 8/1989 | Richter et al. | 423/239 |

*Primary Examiner*—Anthony McFarlane

*Attorney, Agent, or Firm*—Alexander J. McKillop; Charles J. Speciale; Richard D. Stone

[57] ABSTRACT

A process for regeneration of cracking catalyst while minimizing $NO_x$ emissions is disclosed. A DeNOx additive is present in an amount and in a form which reduces $NO_x$ emissions, but does not passivate metals (such as Ni and V) deposited on the catalyst during the cracking reaction nor CO combustion promoter which may be present. Relatively small amounts of antimony oxides impregnated on a separate support having little or no cracking activity are preferred.

14 Claims, No Drawings

REDUCING $NO_x$ EMISSIONS WITH ANTIMONY ADDITIVE

BACKGROUND OF THE INVENTION

1. Field of the Invention

The field of the invention is catalytic cracking of heavy hydrocarbon feeds.

2. Description of Related Art

Catalytic cracking of hydrocarbons is carried out in the absence of externally supplied H2, in contrast to hydrocracking, in which H2 is added during the cracking step. An inventory of particulate catalyst is continuously cycled between a cracking reactor and a catalyst regenerator. In the fluidized catalytic cracking (FCC) process, hydrocarbon feed contacts catalyst in a reactor at 425 C. -600 C., usually 460 C.-560 C. The hydrocarbons crack, and deposit carbonaceous hydrocarbons or coke on the catalyst. The cracked products are separated from the coked catalyst. The coked catalyst is stripped of volatiles, usually with steam, and is then regenerated. In the catalyst regenerator, the coke is burned from the catalyst with oxygen-containing gas, usually air. Coke burns off, restoring catalyst activity and simultaneously heating the catalyst to, e.g., 500 C.-900 C., usually 600 C.-750 C. Flue gas formed by burning coke in the regenerator may be treated for removal of particulates and for conversion of carbon monoxide, after which the flue gas is normally discharged into the atmosphere.

Most FCC units now use zeolite-containing catalyst having high activity and selectivity. These catalysts work best when the amount of coke on the catalyst after regeneration is relatively low. It is desirable to regenerate zeolite catalysts to as low a residual carbon level as is possible. It is also desirable to burn CO completely within the catalyst regenerator system to conserve heat and to minimize air pollution. Heat conservation is especially important when the concentration of coke on the spent catalyst is relatively low as a result of high catalyst selectivity. Among the ways suggested to decrease the amount of carbon on regenerated catalyst and to burn CO in the regenerator is to add a CO combustion promoter metal to the catalyst or to the regenerator. Metals have been added as an integral component of the cracking catalyst and as a component of a discrete particulate additive, in which the active metal is associated with a support other than the catalyst. U.S. Pat. No. 2,647,860 proposed adding 0.1 to 1 weight percent chromic oxide to a cracking catalyst to promote combustion of CO. U.S. Pat. No. 3,808,121, incorporated herein by reference, introduced relatively large-sized particles containing CO combustion-promoting metal into a cracking catalyst regenerator. The circulating particulate solids inventory, of small-sized catalyst particles, cycled between the cracking reactor and the catalyst regenerator, while the combustion-promoting particles remain in the regenerator. Oxidation-promoting metals such as cobalt, copper, nickel, manganese, copper-chromite, etc., impregnated on an inorganic oxide such as alumina, are disclosed.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory.

Many FCC units use CO combustion promoters. This reduces CO emissions, but usually increases nitrogen oxides ($NO_x$) in the regenerator flue gas. It is difficult in a catalyst regenerator to completely burn coke and CO in the regenerator without increasing the $NO_x$ content of the regenerator flue gas.

$SO_x$ emissions are also a problem in many FCC regenerators. $SO_x$ emissions can be greatly reduced by including a $SO_x$ capture additive in the catalyst inventory, and operating the unit at relatively high temperature, in a relatively oxidizing atmosphere. In such conditions, the $SO_x$ additive can adsorb or react with $SO_x$ in the oxidizing atmosphere of the regenerator, and release the sulfur as H2S in the reducing atmosphere of the cracking reactor. Platinum is known to be useful both for creating an oxidizing atmosphere in the regenerator via complete CO combustion and for promoting the oxidative adsorption of SO2. Hirschberg and Bertolacini reported on the catalytic effect of 2 and 100 ppm platinum in promoting removal of SO2 on alumina. Alumina promoted with platinum is more efficient at SO2 removal than pure alumina without any platinum. Unfortunately, those conditions which make for effective $SO_x$ removal (high temperatures, excess O, Pt for CO combustion or for $SO_x$ adsorption) all tend to increase $NO_x$ emissions.

Many refiners have recognized the problem of $NO_x$ emissions from FCC regenerators, but the solutions proposed so far have not been completely satisfactory. Special catalysts have been suggested which hinder the formation of $NO_x$ in the FCC regenerator, or perhaps reduce the effectiveness of the CO combustion promoter used. Process changes have been suggested which reduce $NO_x$ emissions from the regenerator.

Recent catalyst patents include U.S. Pat. No. 4,300,997 and its division U.S. Pat. No. 4,350,615, both directed to the use of Pd-Ru CO combustion promoter. The bi-metallic CO combustion promoter is reported to do an adequate job of converting CO to CO2, while minimizing the formation of $NO_x$.

Another catalyst development is disclosed in U.S. Pat. No. 4,199,435 which suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative to adding less CO combustion promoter the patentee suggests deactivating it in place, by adding something to deactivate the Pt, such as lead, antimony, arsenic, tin or bismuth.

Process modifications are suggested in U.S. Pat. Nos. 4,413,573 and 4,325,833 directed to two-and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches the addition of a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above from U.S. Pat. No. 4,300,997 to U.S. Pat. No. 4,542,114, are incorporated herein by reference.

In addition to the above patents, there are myriad patents on treatment of flue gases containing $NO_x$. The flue gas might originate from FCC units, or other units. U.S. Pat. No. 4,521,389 and U.S. Pat. No. 4,434,147 disclose adding NH3 to $NO_x$ containing flue gas to catalytically reduce the $NO_x$ to nitrogen.

None of the approaches described above provides the perfect solution. Process approaches, such as multistage or countercurrent regenerators, reduce $NO_x$ emissions but require extensive rebuilding of the FCC regenerator.

Various catalytic approaches, e.g., addition of lead or antimony, as taught in U.S. Pat. No. 4,235,704, to degrade the efficiency of the Pt function may help some but still may fail to meet the ever more stringent $NO_x$ emissions limits set by local governing bodies. It is also important, in many FCC units, to maintain the effectiveness of the CO combustion promoter, in order to meet CO emissions limits. Thus it would be beneficial if a catalytic approach were available to reduce $NO_x$ emissions without degrading the effectiveness of Pt as a CO combustion promoter.

I discovered a way to use antimony to reduce $NO_x$ emissions in the flue gas from the regenerator. My method of adding antimony did not deactivate the CO combustion promoter in the regenerator, and had no significant adverse effect in the cracking reactor.

This was surprising, because antimony had never been reported to be an effective catalyst for reducing $NO_x$ emissions in an FCC regenerator. Antimony, and other similar heavy metals such as lead and arsenic, is known to be a poison for Pt, and passivator for Ni and V.

U.S. Pat. No. 4,235,704 suggested adding antimony, or lead, bismuth arsenic or tin to passivate CO combustion promoters such as Pt.

Antimony has achieved widespread use for metals passivation in FCC processes. Generally a soluble antimony compound is added to the FCC feed to react with or interact in some way with Ni and V which are present in the feed, or which have previously been deposited on the catalyst inventory.

No one has suggested that antimony could be added to an FCC unit in a form in which it would be highly effective for minimizing $NO_x$ emissions from an FCC regenerator. I have discovered a form of antimony additive for use in FCC which greatly reduces $NO_x$ emissions, but which is not believed to be active for metals passivation nor for deactivation of platinum CO combustion promoter.

I discovered a way to reduce $NO_x$ emissions from an FCC regenerator, especially from an FCC regenerator operating in complete combustion mode with a CO combustion promoter such as Pt, by adding a antimony additive in a special form. My method of antimony addition reduces $NO_x$ emissions in a way that could not have been predicted from a review of all the prior work on adding antimony.

BRIEF SUMMARY OF THE INVENTION

Accordingly, the present invention provides in a process for the catalytic cracking of a heavy hydrocarbon feed containing Ni and/or V and nitrogen compounds by contact with a circulating inventory of catalytic cracking catalyst to produce catalytically cracked products and spent catalyst comprising Ni and/or V or Ni and/or V compounds and coke comprising nitrogen compounds, and wherein said spent catalyst is regenerated by contact with oxygen or an oxygen-containing gas in a catalyst regeneration zone operating at catalyst regeneration conditions to produce hot regenerated catalyst comprising Ni and/or V or Ni and/or V compounds which is recycled to catalytically crack the heavy feed and said catalyst regeneration zone produces a flue gas comprising CO2 and oxides of nitrogen, $NO_x$, the improvement comprising reducing the $NO_x$ content of the flue gas by adding to the circulating catalyst inventory a separate particle additive comprising antimony, said additive being added in an amount sufficient to reduce the production of $NO_x$ relative to operation without said additive, and wherein said additive comprises a compound of antimony which does not substantially passivate the Ni and/or V or Ni and/or V compounds present on the cracking catalyst.

In another embodiment, the present invention provides in a process for the catalytic cracking of a hydrotreated or low metal heavy hydrocarbon feed, preferably one containing less than 1 ppm Ni and V, and more than 500 ppm N by contact with a circulating inventory of catalytic cracking catalyst containing 0.1 to 10 ppm Pt as a CO combustion promoter, and wherein said feed is cracked by contact with a source of hot regenerated cracking catalyst to produce catalytically cracked products and spent catalyst containing coke comprising nitrogen compounds, and wherein said spent catalyst is regenerated by contact with oxygen or an oxygen-containing gas in a catalyst regeneration zone operating at catalyst regeneration conditions including the presence of excess oxygen or oxygen-containing gas to produce hot regenerated catalyst which is recycled to catalytically crack the heavy feed and flue gas comprising CO2, at least 0.1% O2 and oxides of nitrogen, $NO_x$, the improvement comprising reducing the $NO_x$ content of the flue gas by adding to the circulating catalyst inventory an additive comprising oxides of antimony, said additive being added in an amount sufficient to reduce the production of $NO_x$ relative to operation without said additive.

DETAILED DESCRIPTION

The present invention is an improvement for use in any catalytic cracking unit which regenerates cracking catalyst. The invention will be most useful in conjunction with the conventional all riser cracking FCC units, such as disclosed in U.S. Pat. No. 4,421,636, which is incorporated herein by reference.

Although the present invention is applicable to both moving bed and fluidized bed catalytic cracking units, the discussion that follows is directed to FCC units which are considered the state of the art.

FCC FEED

Any conventional FCC feed can be used. The process of the present invention is useful for processing nitrogenous charge stocks, those containing more than 500 ppm total nitrogen compounds, and especially useful in processing stocks containing very high levels of nitrogen compounds, such as those with more than 1000 wt ppm total nitrogen compounds. There are many high nitrogen, low sulfur and low metal feeds which cause $NO_x$ emission problems even though sulfur emissions are not a problem, and metals passivation is not necessary. There are many crudes like this, such as Nigerian crudes containing more than 1000 ppm N, but less than 0.3 wt% S.

The feeds may range from the typical, such as Nigerian discussed above, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

Hydrotreated feeds, with high residual nitrogen contents, are ideal for use in the process of the present invention. Hydrotreating efficiently removes sulfur and metals from heavy hydrocarbon feeds, but does not remove nitrogen compounds as efficiently. For these hydrotreated gas oils, vacuum gas oils, etc., there is a need for a cost effective method of dealing with $NO_x$ emissions which would allow the units to be pushed to the maximum extent possible. The hydrotreated feeds are readily crackable, and high conversions and gasoline yields can be achieved. However, if $NO_x$ emissions from the regenerator are excessively high the flexibility and severity of FCC operations can be severely limited.

The process of the present inventional will be also be useful when the feed has been subjected to a preliminary thermal treatment, to remove metal and Conradson Carbon Residue material. Thus the feeds contemplated for use herein include those which have been subjected to a "thermal visbreaking" or fluid coking treatment, such as that treatment disclosed in U.S. Pat. No. 4,822,761. The products of such a treatment process would have relatively low levels of metal, similar to metals levels of hydrotreated feed, but would still have a relatively high nitrogen content.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites such as X and Y zeolites, or aluminum deficient forms of these zeolites such as dealuminized Y (DEAL Y), ultrastable Y (USY) and ultrahydrophobic Y (UHP Y) zeolites may be used. The zeolites may be stabilized with Rare Earths, e.g., 0.1 to 10 wt % RE.

Relatively high silica zeolite containing catalysts are preferred for use in the present invention. They withstand the high temperatures usually associated with complete combustion of CO to CO2 within the FCC regenerator. Catalysts containing 10–40% USY or rare earth USY (REUSY) are especially preferred.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

CO combustion additives are available from most FCC catalyst vendors.

The FCC catalyst composition, per se, forms no part of the present invention.

CO COMBUSTION PROMOTER

Use of a CO combustion promoter in the regenerator or combustion zone is not essential for the practice of the present invention, however, it is preferred. These materials are well-known.

U.S. Pat. Nos. 4,072,600 and 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

$SO_x$ ADDITIVES

Additives may be used to adsorb $SO_x$. These are believed to be primarily various forms of alumina, containing minor amounts of Pt, on the order of 0.1 to 2 ppm Pt.

Good additives for removal of $SO_x$ are available from several catalyst suppliers, such as Davison's "R" or Katalistiks International, Inc.'s "DESOX."

The process of the present invention is believed to work well with these additives, in that the effectiveness of the $SO_x$ additive is not impaired by adding my DeNOx additive. Preferably less than 10% degradation in the effectiveness of the $SO_x$ additive, or of the Pt present on the $SO_x$ additive, occurs due to addition of my DeNOx additive.

METALS PASSIVATION

The process of the present invention is not a substitute for conventional metals passivation technology, e.g., the addition of soluble antimony compounds to the feed to reduce the poisoning effects of Ni and V in the feed. When heavy feeds, such as resids or other charge stocks containing a large amount of Ni and/or V are fed to the cracking unit, it may be necessary to add a soluble antimony compound to the feed for metals passivation. Other conventional forms of metals passivation may also be practiced.

Preferably, the amount and form of my antimony additive does not substantially passivate the metals present in the circulating catalyst inventory, i.e., addition of enough of my additive to reduce $NO_x$ emissions should not achieve more than about 10% passivation of Ni and V present in the catalyst inventory. Expressed another way, my separate particle additive should not be very effective for metals passivation, and will have less than one half of the effectiveness, on an elemental antimony basis, of soluble antimony compounds added to the feed to the FCC.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 5 seconds, and most preferably about 0.75 to 4 seconds, and riser top temperatures of 900 to about 1050 F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

CATALYST REGENERATION

The process and apparatus of the present invention can use conventional FCC regenerators.

Preferably a high efficiency regenerator is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention.

EXAMPLES

A series of tests were conducted to determine the effectiveness of my additive. The tests were run in a small, laboratory micro-unit operating with 10 g of spent equilibrium FCC catalyst taken from a commercial FCC unit. Chemical and physical properties are reported in Table 1.

TABLE 1

| SPENT CATALYST PROPERTIES | |
|---|---|
| Surface Area, $m^2/g$ | 133 |
| Bulk Density, g/cc | 0.80 |
| Al203, wt % | 43.2 |
| Carbon, wt % | 0.782 |
| Nickel, ppm | 1870 |
| Vanadium, ppm | 1000 |
| Sodium, ppm | 3000 |
| Copper, ppm | 28 |
| Iron, ppm | 5700 |
| Platinum, ppm | 1.4 |
| Nitrogen, ppm | 160 |

EXAMPLE 1

Prior Art

Example 1 is a base case or prior art case operating without antimony.

A 10 g sample of the spent catalyst was placed in a laboratory fixed fluidized bed regenerator and regenerated at 1300 F. by passing 200 cc/min of a regeneration gas comprising 10% O2 and 90% N2. $NO_x$ emissions in the resulting flue gas were determined via chemiluminescence, using an Antek 703C $NO_x$ detection system.

EXAMPLE 2

Invention

Example 1 was repeated, but this time 0.5 g of chemical grade antimony trioxide (Fisher) powder was added to the 10 g sample of spent catalyst. The DeNOx activity was determined by comparing the integrated $NO_x$ signal to the base case without additive. The integrated $NO_x$ signal roughly corresponds to the average performance that would be expected in a commercial FCC unit, operating at steady state conditions. The integrated $NO_x$ was reduced 65%.

EXAMPLES 3–4

Example 1 was repeated, using oxides of Ti and Zr. These additives did not reduce $NO_x$. The results are summarized below in Table 2.

TABLE 2

| EXAMPLE | ADDITIVE | % REDUCTION IN $NO_x$ |
|---|---|---|
| 1 (base) | none | base |
| 2 | $Sb_2O_3$ | 65% |
| 3 | TiO2 | 1% |
| 4 | ZrO2 | (3%) |

The above data show that separate particles of antimony additive are effective at reducing $NO_x$ emissions from an FCC regenerator.

The process of the present invention gives FCC operators more flexibility in solving emissions problems than they previously had. It is now possible to independently control CO, $SO_x$ and $NO_x$ emissions.

CO emissions can be controlled by adjusting regenerator conditions (usually excess oxygen and temperature) and addition of sufficient CO combustion promoter.

$SO_x$ emissions can be controlled by control of regenerator conditions and by adding varying amounts of $SO_x$ capture additives. Usually conditions which favor complete combustion of CO also favor $SO_x$ capture.

$NO_x$ emissions will of course change if the regenerator is run hotter, and with more excess air (to reduce, e.g., $SO_x$), but a refiner can now compensate. Separate particle antimony additives of the invention can significantly reduce $NO_x$ emissions. The antimony additive of the invention is not believed to deactivate the Pt CO combustion promoter used, nor is it believed to deactivate the Pt present on the sulfur capture additive.

To meet stringent local requirements a refiner can fine tune the operation of the regenerator, e.g., by adding more Pt CO combustion promoter to permit complete CO combustion to be achieved with less excess 02 in the flue gas, and allow the reduced O2 content to reduce somewhat the $NO_x$ emissions.

The process of the present invention will work well in regenerators operating at 1000 to 1650 F., preferably at 1150 to 1500 F., and most preferably at 1200 to 1400 F. $NO_x$ emissions will be reduced over a large range of excess air conditions, ranging from 0.1 to 5% O2 in flue gas. Preferably the flue gas contains 0.2 to 4% O2, and most preferably 0.5 to 3% O2.

The process of the present invention permits feeds containing more than 500 ppm nitrogen compounds to be processed easily, and even feeds containing 1000 or 1500 ppm N or more can now be cracked with reduced $NO_x$ emissions.

The process of the present invention is especially suited for use with hydrotreated feeds, or feeds which have not been hydrotreated but which have relatively low levels of Ni and V in the feed. For these feeds, metals passivation is not necessary, and the FCC regenerator can usually be run in complete CO combustion mode. $NO_x$ emissions can easily be a problem in such an operation, especially when highly oxidizing conditions are present in the regenerator, to promote capture of $SO_x$ on additives. Metals passivation is not necessary under such conditions, but reducing $NO_x$ emissions usually will be. It is important to have a DeNOx catalyst which will not only be effective at reducing $NO_x$ emissions under oxidizing conditions, but which will have little or no adverse effect on Pt present either for CO combustion promotion or to promote sulfur oxidation.

The use of separate particle addition of antimony compounds is also believed to be the most rigorous way to add Sb to an FCC unit, and to keep it in the unit. Addition of soluble antimony compounds to the feed to an FCC unit is believed to deposit a relatively large amount of antimony on catalyst fines, which are rapidly lost from the system. Although the precise antimony loss mechanism is not completely understood now, it is believed that much of the loss is due to the method in which antimony is added, namely in a highly dispersed form, to rapidly react with Ni and V compounds which are deposited on the surface of the cracking catalyst. My additive will be in a relatively poor form for metals passivation, but it is not as likely to be rapidly lost from the unit either. Separate particles of antimony, which are preferred for use herein, will probably be no more than 50% effective, regards metals passivation, as addition of a like amount of antimony, as a hydrocarbon soluble antimony compound added to the FCC feed. Preferably the separate particle additive is less than 25% as effective at metals passivation as compared to addition of a like amount of antimony, as a hydrocarbon soluble antimony compound added to the FCC feed.

The amount of Sb present in the additive can vary from 0.5 to 84 wt %, on an elemental metal basis, but preferably the additive contains 1 to 20 wt % Sb, and most preferably 2 to 15 wt % Sb.

The Sb additive may comprise from 0.1 to 20 wt % of the equilibrium catalyst, and preferably comprises 0.2 to 10 wt %, and most preferably 0.5 to 5 wt % of the catalyst inventory.

The amount of Sb additive present may also be adjusted based on the amount of nitrogen in the feed, with 0.05 to 50 weights of Sb being present on catalyst per weight of feed nitrogen, and preferably 0.1 to 20 and most preferably 0.5 to 10 weights of Sb on catalyst per weight of feed nitrogen.

The reduced loss of antimony achievable by using a form of antimony which is not highly dispersed will reduce contamination of the products or the environment with antimony. Loss of antimony, or difficulties in running an antimony balance of an FCC unit practicing metals passivation with soluble antimony compounds, has led many refineries to stop adding antimony for metals passivation. In the process of my invention, safe antimony addition can be practiced, by using a less fugacious form of antimony. In a preferred embodiment, the antimony compound can be contained in a protective layer of porous material having a high attrition resistance, so that the antimony additive will survive for a long time, and remain in, the catalytic cracking unit. Preferably the antimony additive is used in a form in which it has an attrition index, as measured by the Davison Attrition Index Method 304, of less than 15, more preferably less than 10, and most preferably of less than 8.

In a related embodiment, the antimony is contained in a matrix which has a relatively low cracking activity. Use of a low acidity matrix will reduce to some extent the amount of coke or carbon deposited on the antimony additive, which will reduce the localized high temperatures experienced by the additive in the FCC regenerator. The separate particles of antimony oxide used in the experiment have very low catalytic activity, and should experience relatively low surface temperatures in the regenerator as compared to the surface temperatures experienced by conventional FCC catalyst. The surface temperatures of Ni and V contaminated catalyst are believed to be relatively higher than the surface temperature of conventional FCC catalyst, because the Ni and V promote carbon condensation reactions which form coke and contribute to high temperatures.

For use in units with hydrotreated feed, or thermally treated or distilled feed which has a low metals content, it will be possible to use an antimony additive which comprises an antimony oxide or precursor thereof disposed on a support which has some cracking activity. The antimony oxide may even be deposited on a portion of the cracking catalyst inventory, or be deposited on fresh cracking catalyst which is then added to the circulating inventory of equilibrium catalyst.

I claim:

1. In a process for the catalytic cracking of a heavy hydrocarbon feed containing Ni and nitrogen compounds by contact with a circulating inventory of catalytic cracking catalyst to produce catalytically cracked products and spent catalyst comprising Ni or Ni compounds and coke comprising nitrogen compounds, and wherein said spent catalyst is regenerated by contact with oxygen or an oxygen-containing gas in a catalyst regeneration zone operating at catalyst regeneration conditions to produce hot regenerated catalyst comprising Ni or Ni compounds which is recycled to catalytically crack the heavy feed and said catalyst regeneration zone produces a flue gas comprising CO, CO2 and oxides of nitrogen, $NO_x$, the improvement comprising adding to the circulating catalyst inventory CO combustion promoter in an amount equivalent to 0.01 to 50 wt ppm Pt to reduce the CO content of the flue gas and reducing the $NO_x$ content of the flue gas by adding to the circulating catalyst inventory a separate particle additive comprising antimony, said additive being added in an amount sufficient to reduce the production of $NO_x$ relative to operation without said additive, and wherein said additive comprises a compound of antimony which does not substantially passivate the Ni or Ni compounds present on the cracking catalyst, nor deactivate the CO combustion promoter.

2. The process of claim 1 wherein the additive comprises oxides of antimony present as discrete particles which contain 0.5 to 84.0 wt % antimony on an elemental metal basis.

3. The process of claim 1 wherein the antimony additive is oxides of antimony on separate particles, the additive particles comprise 0.2 to 10 wt % of the circulating catalyst inventory and the particles contain 1 to 20 wt % antimony on an elemental metal basis.

4. The process of claim 1 wherein the antimony additive is added in the form of oxides of antimony deposited on a support, and wherein the cracking catalyst has a cracking activity and the antimony additive has less cracking activity than the cracking catalyst.

5. The process of claim 1 wherein the antimony additive is added in the form of oxides of antimony which are incorporated into the cracking catalyst particles or the antimony is incorporated into a support which has cracking activity.

6. The process of claim 1 wherein $NO_x$ emissions in the flue gas are reduced by at least 25%.

7. The process of claim 1 wherein the heavy feed contains more than 500 wt ppm nitrogen, the cracking catalyst inventory contains 0.1 to 10 wt ppm Pt to promote CO combustion, and more than 1000 wt ppm (Ni+V) which cause undesired hydrogenation/dehydrogenation reactions to occur in the catalytic cracking reaction and the cracking catalyst inventory contains from 0 to 20 wt % of a sulfur getter containing from 0.1 to 10 wt ppm Pt to promote sulfur oxidation, and wherein 1 to 20 wt % additive comprising 0.2 to 10 wt % antimony, on an elemental metal basis, is added to the catalyst inventory in the form of separate particles and wherein $NO_x$ emissions are reduced at least 25% relative to operation at the same regenerator conditions without antimony addition, and wherein the Pt CO combustion promoter retains at least 90% of its CO oxidation activity in the presence of the antimony additive and less than 10% passivation of the hydrogenation/dehydrogenation reactions occurs due to the presence of the antimony additive.

8. The process of claim 1 wherein the antimony additive is selected from the group consisting of particles of $Sb_2O_3$, $Sb_2O_4$ $Sb_2O_5$, and particles of a support impregnated and calcined to contain from 2 to 15 wt % antimony, on an elemental metal basis, in the form of oxides of antimony.

9. In a process for the catalytic cracking of a hydrotreated, thermally treated, or distilled low metal heavy hydrocarbon feed containing less than 1 ppm (Ni and V) and more than 500 ppm N by contact with a circulating inventory of catalytic cracking catalyst containing 0.1 to 10 ppm Pt as a CO combustion promoter, and wherein said feed is cracked by contact with a source of hot regenerated cracking catalyst to produce catalytically cracked products and spent catalyst containing coke comprising nitrogen compounds, and wherein said spent catalyst is regenerated by contact with oxygen or an oxygen-containing gas in a catalyst regeneration zone operating at catalyst regeneration conditions including the presence of excess oxygen or oxygen-containing gas to produce hot regenerated catalyst which is recycled to catalystically crack the heavy feed and flue gas comprising CO2, at least 0.1% O2 and oxides of nitrogen, $NO_x$, the improvement comprising reducing that $NO_x$ content of the flue gas by adding to the circulating catalyst inventory an additive comprising oxides of antimony, said additive being added in an amount sufficient to reduce the production of $NO_x$ relative to operation without said additive, and in a form which does not deactivate the CO combustion promoter.

10. The process of claim 9 wherein the additive comprises oxides of antimony present as discrete particles which contain 0.5 to 84.0 wt % antimony on an elemental metal basis.

11. The process of claim 9 wherein the antimony additive is oxides of antimony on separate particles, the additive particles comprise 0.2 to 10 wt % of the circulating catalyst inventory and the particles contain 1 to 20 wt % antimony on an elemental metal basis.

12. The process of claim 9 wherein the antimony additive is added in the form of oxides of antimony deposited on a support, and wherein the cracking catalyst has a cracking activity and the antimony additive has less cracking activity than the cracking catalyst.

13. The process of claim 9 wherein the antimony additive is added in the form of oxides of antimony which are incorporated into the cracking catalyst particles or the antimony is incorporated into a support which has cracking activity.

14. The process of claim 9 wherein $NO_x$ emissions in the flue gas are reduced by at least 50%.

* * * * *